US005533613A

United States Patent [19]

Minarelli et al.

[11] Patent Number: 5,533,613

[45] Date of Patent: Jul. 9, 1996

[54] CIGARETTE PACKET

[75] Inventors: Alessandro Minarelli, Bazzano; Marco Brizzi, Zola Predosa, both of Italy

[73] Assignee: G. D S.p.A., Bologna, Italy

[21] Appl. No.: 375,948

[22] Filed: Jan. 20, 1995

[30] Foreign Application Priority Data

Jan. 20, 1994 [IT] Italy ..... BO94A0012

[51] Int. Cl.[6] ..... B65D 85/10

[52] U.S. Cl. ..... 206/268; 206/271; 206/273; 206/242; 206/831

[58] Field of Search ..... 206/268, 264, 206/265, 270, 271, 273, 242, 831; 229/160.1, 70, 87.14, 155

[56] References Cited

U.S. PATENT DOCUMENTS

| | | | |
|---|---|---|---|
| 1,521,796 | 1/1925 | Spittell | 229/155 X |
| 1,967,204 | 7/1934 | Genz | 206/264 |
| 3,104,795 | 9/1963 | Adams | 229/155 |
| 4,103,820 | 8/1978 | Mathison et al. | 206/831 X |
| 5,074,462 | 12/1991 | Countee, Jr. | 229/155 |
| 5,137,148 | 8/1992 | Evers | 206/271 |
| 5,160,024 | 11/1992 | Evers | 206/268 |
| 5,178,272 | 1/1993 | Evers | 206/264 |
| 5,236,084 | 8/1993 | Evers | 206/273 |
| 5,363,955 | 11/1994 | Fleenor | 206/273 |
| 5,375,704 | 12/1994 | Focke et al. | 206/268 |

FOREIGN PATENT DOCUMENTS

| | | | |
|---|---|---|---|
| 0476882 | 3/1992 | European Pat. Off. | B65D 85/10 |
| 3631212 | 3/1988 | Germany | B65D 5/16 |
| 8816039 | 6/1989 | Germany | B65D 5/42 |
| 4122900 | 1/1993 | Germany | B65D 85/10 |
| 533003 | 2/1941 | United Kingdom . | |

*Primary Examiner*—Paul T. Sewell
*Assistant Examiner*—Tara L. Laster
*Attorney, Agent, or Firm*—Cushman Darby & Cushman

[57] ABSTRACT

In a cigarette packet of the type with a hinged lid composed of a rigid box and a soft inner wrapping directly enveloping the cigarettes, the lid end is reinforced internally by a frame lodged between the wrapping and the box, and the packet often assembled with a leaflet or coupon inserted between the frame and the wrapping. To ensure that the coupon does not slip out of place as assembly operations proceed, the frame or the coupon itself is fashioned with at least one slot position to interlock with a corresponding part of the coupon or the frame, accordingly.

6 Claims, 1 Drawing Sheet

FIG. 1
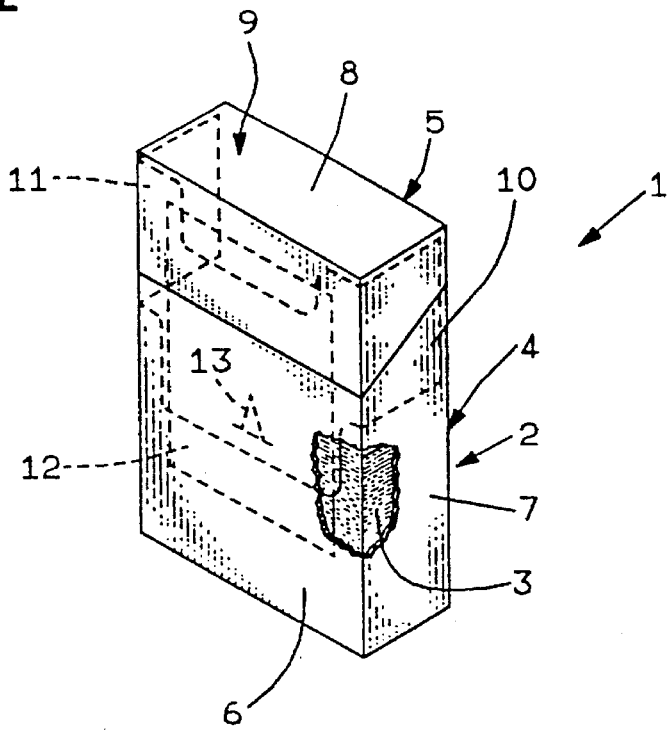
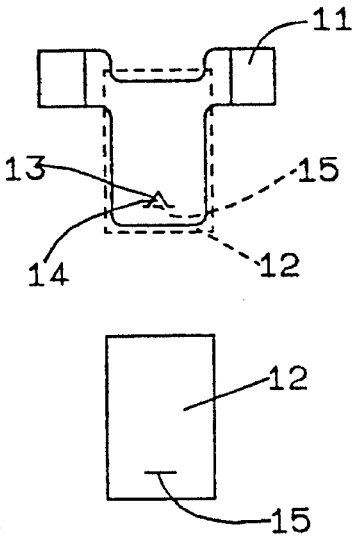
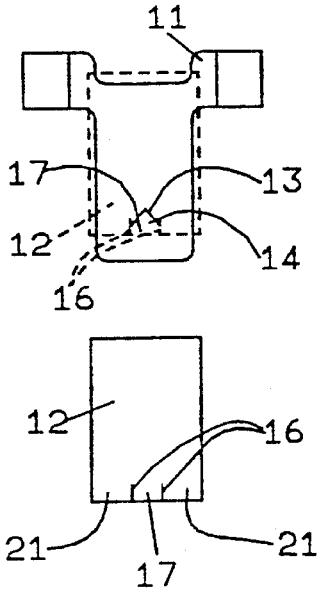
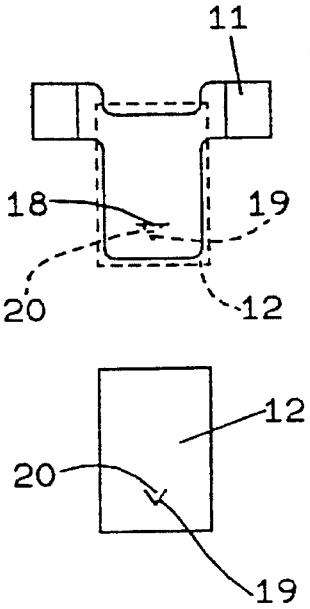
FIG. 2 FIG. 3 FIG. 4

CIGARETTE PACKET

BACKGROUND OF THE INVENTION

The present invention relates to a cigarette packet.

In particular, the present invention relates to a cigarette packet of the rigid type with a hinged lid, which in addition to the cigarettes may also contain a "coupon", i.e. a card or leaflet bearing an advertising message or other information. The hinged lid type of cigarette packet essentially comprises an outer container of box-like appearance and, inside the container, a wrapping of pliable material, typically foil-backed paper, fashioned in such a manner as to envelop a group of cigarettes arranged one alongside another.

The outer container is composed of a substantially parallelepiped box element, a lid element hingedly associated with the top edge afforded by one of the longer and broader faces of the box element, and an internal element or frame, of cardboard, interposed between a top front portion of the box element and a top front portion of the inner wrapping.

It is frequently the practice when manufacturing packets of this type to place an advertising coupon between the frame and the inner wrapping, which the smoker will remove immediately on opening up the packet for the first time.

The manufacture of cigarette packets with coupons enclosed is conditioned by one especially critical factor, namely, that by reason of the high speeds at which modern manufacturing machines are able to operate, it is considerably difficult to be certain when positioning a coupon against the frame or the wrapping, before the frame and wrapping are brought together, that the coupon will remain correctly in place. It often happens, in effect, due to inertia or to aerodynamic forces, that the coupon is caused to shift away from its initial position in contact with the frame and/or with the wrapping, before the packet is completed.

SUMMARY OF THE INVENTION

The object of the present invention is to provide a cigarette packet of the type in question, embodied in such a manner that the coupon will be prevented from assuming an incorrect position during assembly of the packet.

The stated object is realized in a cigarette packet according to the present invention, which is of the rigid type with a hinged lid, comprising a box-like container, an inner wrapping enveloping a group of cigarettes, and two further elements located within the container, consisting respectively in a frame disposed between the wrapping and the container and a leaflet or coupon inserted between the frame and the inner wrapping. To advantage, at least one of these two elements, frame or coupon, is furnished with at least one slot such as can be engaged by a corresponding portion of the other element.

BRIEF DESCRIPTION OF THE DRAWINGS

The invention will now be described in detail, by way of example, with the aid of the accompanying drawings, in which:

FIG. 1 is a schematic illustration of a cigarette packet embodied according to the present invention, viewed in perspective;

FIG. 2 illustrates certain details of the packet of FIG. 1, seen in isolation;

FIG. 3 illustrates an alternative embodiment of the details shown in FIG. 2;

FIG. 4 illustrates a further alternative embodiment of the details shown in FIG. 2.

DESCRIPTION OF THE PREFERRED EMBODIMENTS

With reference to FIG. 1 of the drawings, 1 denotes a cigarette packet, in its entirety, of the rigid type with a hinged lid, which comprises a box-like container of substantially parallelepiped shape fashioned from cardboard, and an inner wrapping 3 of foil-backed paper folded around and enveloping a group of cigarettes (not illustrated).

Still in FIG. 1, the box-like container 2 comprises a box element 4 of which the end uppermost is open, and a lid 5 hingedly associated with one top edge of the box element.

Reference is made in the present specification to a packet 1 of the aforementioned type as illustrated in FIG. 1, with the longitudinal axis vertically disposed, and it is in relation to this position of the packet 1 that reference is made when describing positional details of the packet's component parts. The box-like container 2 exhibits two predominant or larger faces 6 (one only of which is indicated in FIG. 1) disposed parallel and mutually opposed, and four smaller faces of which two, denoted 7, are disposed vertically and mutually opposed and two, denoted 8, are disposed horizontally and mutually opposed. These same four faces 8 and 7 coincide respectively with the bottom end face (not shown) and the top end face 9 of the packet 1, and with the two lateral or flank faces (one only of which is shown).

The lid 5 is hinged to the box element 4 along an axis parallel with the longitudinal dimension of the top end face 8.

The packet 1 further comprises an inner element or frame 11 positioned internally of the box element 4 in conventional manner, that is to says interposed between the wrapping 3 and a portion of the front face 6 and secured thus to the latter by means of a layer of adhesive material (not indicated).

Also discernible in FIG. 1 is a rectangular leaflet or coupon 12 bearing selected advertising messages and/or images, inserted between the frame 11 and a corresponding portion of the inner wrapping 3.

In the example of FIGS. 1 and 2, the lower portion of the frame 11 exhibits a slot 13 cut in a central position and appearing substantially as a chevron with the vertex directed upward, thereby creating a tongue 14 of substantially triangular shape in the frame 11.

Still observing FIG. 1 and more particularly FIG. 2, the coupon 12 exhibits a horizontal slot 15, cut centrally in a lower portion, of which the length is marginally greater than the maximum horizontal dimension of the triangular slot 13 afforded by the frame 11.

In the course of manufacturing the packet 1, prior to the insertion of the frame 11 between the inner wrapping 3 and the corresponding face 6 of the box element, the angled slot 13 is spread apart (a step not described, being only incidental in the context of the present invention) sufficiently to distance the point of the tongue 14 from the main body of the frame 11 and enable its introduction into the slot 15 afforded by the coupon 12. Thereafter, the coupon 12 will assume a position relative to the frame 11 as indicated with phantom lines in FIG. 2, and the two elements remain thus in a substantially stable association.

Consequently, the frame 11 and the coupon 12 can be handled with ease through to the completion of the packet 1, with no more than a minimal risk of their mutual positions being upset.

The alternative solution illustrated in FIG. 3 is pertinent in particular where the frame 11 may be of relatively considerable length, measured in the direction parallel with the longitudinal axis of the packet 1, in which case the horizontal slot 15 may be omitted and the coupon 12 positioned instead with its bottom edge inserted between the tongue 14 and the body of the frame 11 during the assembly of the packet 1. In this instance, the coupon 12 can be provided preferably with two vertical slots 16 cut in a central portion of the bottom edge and spaced apart at a distance substantially identical to the maximum transverse dimension of the angled slot 13, in such a way as to create a downwardly extending tongue 17 which, when the coupon 12 is offered in contact to the frame 11, will enter the slot 13 substantially to full depth as indicated by the phantom lines in FIG. 3.

Another solution (discernible from FIG. 3) can be adopted in particular where the coupon 12 is either short, or creased and flattened over the topmost end face of the wrapping 3: the frame 11 can be devoid of slots altogether, whilst the bottom end of the coupon 12 can again be provided with two vertical slots 16, in this instance slipped over the top edge of the frame 11 such that the central tongue 17 and the two lateral tongues 21 (FIG. 3) remain locked on either side, straddling the top edge.

FIG. 4 illustrates a further variation in embodiment of the packet shown in FIGS. 1 and 2, in which the frame 11 might be provided with a slot 18 identical to the slot denoted 15, and the coupon 12 with a slot 19 shaped identically to the slot denoted 13 but having the chevron point directed downwards. In this instance, naturally, it will be the tongue 20 of the slot 19 afforded by the coupon 12 that is inserted into the slot 18 afforded by the frame 11, substantially in the manner already described.

In accordance with the spirit of the invention, it may be asserted broadly that a correct and stable positioning of the coupon 12 in relation to the frame 11 can be guaranteed by cutting at least one slot in the frame 11 or in the coupon 12, placed at any given point and in such a way as to enable its engagement by a given portion of the coupon 12 or the frame 11, respectively, which in turn may also incorporate at least one slot.

As will be evident from the foregoing, the stated object is fully realized in a cigarette packet 1 according to the present invention, the embodiment of which being such that the coupon 12 is prevented from assuming an incorrect position in relation to the frame 11 during manufacture.

What is claimed:

1. A parallelepiped-shaped cigarette packet having a bottom, a top, a front, a back, and left and right side walls, said pack being elongated along a longitudinal axis extending in a top to bottom direction, said packet comprising:

a container box;

an inner wrapping enveloping a group of cigarettes and disposed within said box;

a frame sleeved within said box between said box and said inner wrapping; and a leaflet or coupon interposed within said box between said frame and said inner wrapping;

said leaflet or coupon and said frame each having two opposite faces;

at least one of said leaflet or coupon and frame being provided with at least one slot extending widthwise of said packet;

at least the other of said leaflet or coupon and frame being provided with a tongue having a length extending longitudinally of said packet;

each said tongue being received through a corresponding said slot so that said tongue throughout the length thereof is disposed against an opposite face of the respective said at least one of said leaflet or coupon and frame relative to the remainder of said at least other of said leaflet or coupon and frame.

2. The cigarette packet of claim 1, wherein:

at least one said slot is provided in said frame.

3. The cigarette packet of claim 2, wherein:

at least another said slot is provided in said leaflet or coupon.

4. The cigarette packet of claim 1, wherein:

at least one said slot is provided in said leaflet or coupon.

5. The cigarette packet of claim 2, wherein:

said leaflet or coupon has a lower edge, and a said tongue is defined by two laterally spaced, parallel slots provided in said leaflet or coupon so as to be contiguous to said edge.

6. A parallelepiped-shaped cigarette packet having a bottom, a top, a front, a back, and left and right side walls, said pack being elongated along a longitudinal axis extending in a top to bottom direction, said packet comprising:

a container box;

an inner wrapping enveloping a group of cigarettes and disposed within said box;

a frame sleeved within said box between said box and said inner wrapping; and a leaflet or coupon interposed within said box between said frame and said inner wrapping;

said leaflet or coupon and said frame each having two opposite faces;

said frame having an upper edge extending widthwise of said packet;

said leaflet or coupon having a lower edge extending widthwise of said packet and being provided with a tongue having a length extending longitudinally of said packet, said tongue being defined by two laterally spaced, parallel slots provided in said leaflet or coupon so as to be contiguous with said lower edge;

each said parallel slots receiving said upper edge so that said tongue throughout the length thereof is disposed against an opposite face of the frame relative to the two remainders of said leaflet or coupon frame respectively defined so as to extend leftwardly of the leftmost of said parallel slots, and rightwardly of the rightmost of said parallel slots.

* * * * *